US008434530B2

(12) United States Patent
Conforti

(10) Patent No.: US 8,434,530 B2
(45) Date of Patent: May 7, 2013

(54) FILLER VALVE UNIT

(75) Inventor: Lucio Conforti, Fornovo di Taro (IT)

(73) Assignee: Sidel International AG, Hunenberg (CH)

( * ) Notice: Subject to any disclaimer, the term of this patent is extended or adjusted under 35 U.S.C. 154(b) by 432 days.

(21) Appl. No.: 12/516,746

(22) PCT Filed: Nov. 29, 2006

(86) PCT No.: PCT/IT2006/000828

§ 371 (c)(1),
(2), (4) Date: May 28, 2009

(87) PCT Pub. No.: WO2008/065685

PCT Pub. Date: Jun. 5, 2008

(65) Prior Publication Data

US 2010/0065150 A1 Mar. 18, 2010

(51) Int. Cl.

| | |
|---|---|
| ***B65B 31/00*** | (2006.01) |
| ***B65B 1/04*** | (2006.01) |
| ***B65B 3/04*** | (2006.01) |
| ***B65B 43/42*** | (2006.01) |
| ***B67C 3/26*** | (2006.01) |

(52) U.S. Cl.

USPC ..... 141/66; 141/59; 141/60; 141/65; 141/105; 141/148; 141/275

(58) Field of Classification Search ..... 141/1, 57, 141/59, 60, 65, 66, 100, 104, 105, 148, 253, 141/275, 277; 251/129.15

See application file for complete search history.

(56) References Cited

U.S. PATENT DOCUMENTS

| | | | | |
|---|---|---|---|---|
| 3,633,635 | A * | 1/1972 | Kaiser | 141/40 |
| 4,586,548 | A * | 5/1986 | Hinxlage | 141/57 |
| 4,721,138 | A * | 1/1988 | Simonazzi | 141/150 |
| 5,295,517 | A * | 3/1994 | Ahlers | 141/1 |
| 5,320,144 | A * | 6/1994 | Ahlers | 141/1 |
| 6,189,578 | B1 * | 2/2001 | Clusserath | 141/7 |
| 6,463,964 | B2 * | 10/2002 | Clusserath | 141/40 |
| 6,817,386 | B2 * | 11/2004 | Tsukano et al. | 141/57 |
| 2005/0178466 | A1 * | 8/2005 | Tanikawa et al. | 141/57 |

FOREIGN PATENT DOCUMENTS

| | | | |
|---|---|---|---|
| DE | 94 12 952 | U1 | 9/1995 |
| EP | 0 498 318 | A2 | 8/1992 |
| EP | 0 634 357 | A2 | 1/1995 |
| EP | 1 544 157 | A1 | 6/2005 |
| NL | 8701128 | A | 12/1988 |

* cited by examiner

*Primary Examiner* — Ryan Reis
(74) *Attorney, Agent, or Firm* — Pearne & Gordon LLP

(57) ABSTRACT

A filler valve unit (1) for feeding a preset amount of filling liquid (3) into a container (6) having an outlet (4) for feeding out filling liquid and an outlet (11) for injecting gaseous fluid. The filler valve unit (1) comprises at least one stop element (14) forming a stroke limiter acting on the container (6). According to the invention, the stop element (14) is mobile and moves between at least two operating positions consisting of a first operating position wherein the stop element holds the mouth (5) of a container (6) at a preset distance from the outlet (4) and a second operating position wherein the stop element (14) holds the mouth (5) of the container (6) at a distance from the outlet (4) which is less than the preset distance.

15 Claims, 3 Drawing Sheets

FILLER VALVE UNIT

TECHNICAL FIELD AND BACKGROUND ART

In the bottling industry the known technology for filling containers such as bottles, cans and jars involves the use of filling machines equipped with a plurality of filler heads each of which is fitted with a filler valve.

In the known method there are electro-pneumatic filler valves fitted with an electronic control system operating pneumatic actuators which control the movements of the moving parts of the valves.

In the sector for filling plastic containers, such as those made of PET, with liquids which are sensitive to oxygen, the filling stage is preceded by a flushing stage where an inert gas or carbon dioxide is injected into the container in order to eliminate any oxygen present in the container.

Flushing is used with PET containers in particular because a vacuum method cannot be used: creating a high vacuum inside a container made from PET would irreparably damage the container.

The known types of filler valves have a first pipe for feeding out a liquid from a tank and a second pipe designed to allow the gas, previously injected into the container, to escape during the filling stage.

The second pipe is coaxially positioned inside the liquid feed pipe and slides up and down inside this pipe so that it can be inserted into the container. Usually the second pipe has a projection on its outer surface at a point between its two ends. This projection acts a stop valve inside the liquid feed pipe. When the second pipe moves up and down, the projection opens and closes the space where the liquid flows through.

In another version of the know method, there is no first liquid feed pipe and the tank containing the liquid to be filled is directly connected to the container to be filled by a passage which is alternately opened and closed by a mobile valve which is usually coaxial to the second pipe which in this case is fixed.

According to this known method, the filler valve is usually fixed and the container to be filled, a PET bottle for example, moves up and down with an alternating motion on the vertical axis. The container moves between two positions. In the first, flushing position, the container is moved close to the feed section of the valve so as to allow the second pipe to enter the container and inject the gas. In the flushing position, the mouth of the container is not resting sealed against the feed section of the valve. In the second filling position the container is moved towards the filler valve so that the mouth of the container rests against and is sealed to the feed section of the valve. This action prevents oxygen from entering the container during filling.

In addition to the two operating positions described above, the container also has a rest position which is the position it takes up when the filling machine is being loaded.

FIG. 1 shows the prior art where the container is usually moved by a pneumatic cylinder 100. In the case where PET bottles 101 are being filled, the pneumatic cylinder has pickup means 102 for holding the neck of the container. At present, the duration of the flushing stage is controlled by a suitably shaped mechanical cam 103 and a roller 104 running on the cam and connected to the pneumatic cylinder 100.

On rotary filling machines this cam has a two-step profile with:

- a first section at a fixed height from the floor;
- a downward connecting section followed by a second section at a fixed height which is lower than that of the first section;
- an upward section followed by a third section at a fixed height which is substantially the same as the height of the first section.

The fixed height sections and the connecting sections alternate in the direction of rotation of the filling machine.

The length of the second (lower) fixed height section is used to define the duration of the flushing stage.

The roller connected to the pneumatic cylinder follows the cam profile so that the container first moves downwards from the loading position to the flushing to position and then moves upwards from the flushing position to the filling position.

In brief, filler valves of the known type require a cam with a predefined profile and length in order to control movements of the container and to control its distance from the filler valve; the cam profile and length control the duration of the filler stage.

The filler valves briefly described above have considerable disadvantages.

The main disadvantage is that they do not permit size changeovers. In cases where containers of a different size are to be filled, the filling machine must be stopped and the cam must be substituted with another cam which has a suitable length and profile for the new flushing stage duration. The duration of the flushing stage is substantially proportional to the volume of the container to be filled. As the volume of the container increases so too does the time needed to completely flush out the oxygen inside the container.

A further disadvantage of fillers valves of the known type is that in the event of a machine stoppage they do not permit the completion of the filling cycle for containers which have already been flushed but which have not yet reached the feed section of the valve. The presence of a cam with a predefined and fixed profile does not allow the container to approach the feed section of the valve in order to start filling and expel the flushing fluid. This allows oxygen to enter the container once again. This causes unnecessary waste of carbon dioxide or inert gas. This also causes a loss of productivity because the containers which have been treated with gas but not filled must be thrown away.

DISCLOSURE OF INVENTION

The purpose of the present invention is to overcome the disadvantages described above by providing a filler valve unit which permits a rapid size changeover for the containers to be filled.

A further purpose of the present invention is to provide a filler valve unit which optimises the productivity of filling equipment by eliminating the waste of flushing gas and reject containers.

These purposes are fulfilled by the filler valve unit described in the present invention and characterised in the claims below.

BRIEF DESCRIPTION OF DRAWINGS

These and other purposes are illustrated in greater detail in the description and drawings of a preferred embodiment which follow below. This embodiment is provided as an example only and is in now way limiting. The drawings are as follows.

BEST MODE FOR CARRYING OUT THE INVENTION

Figure 1:
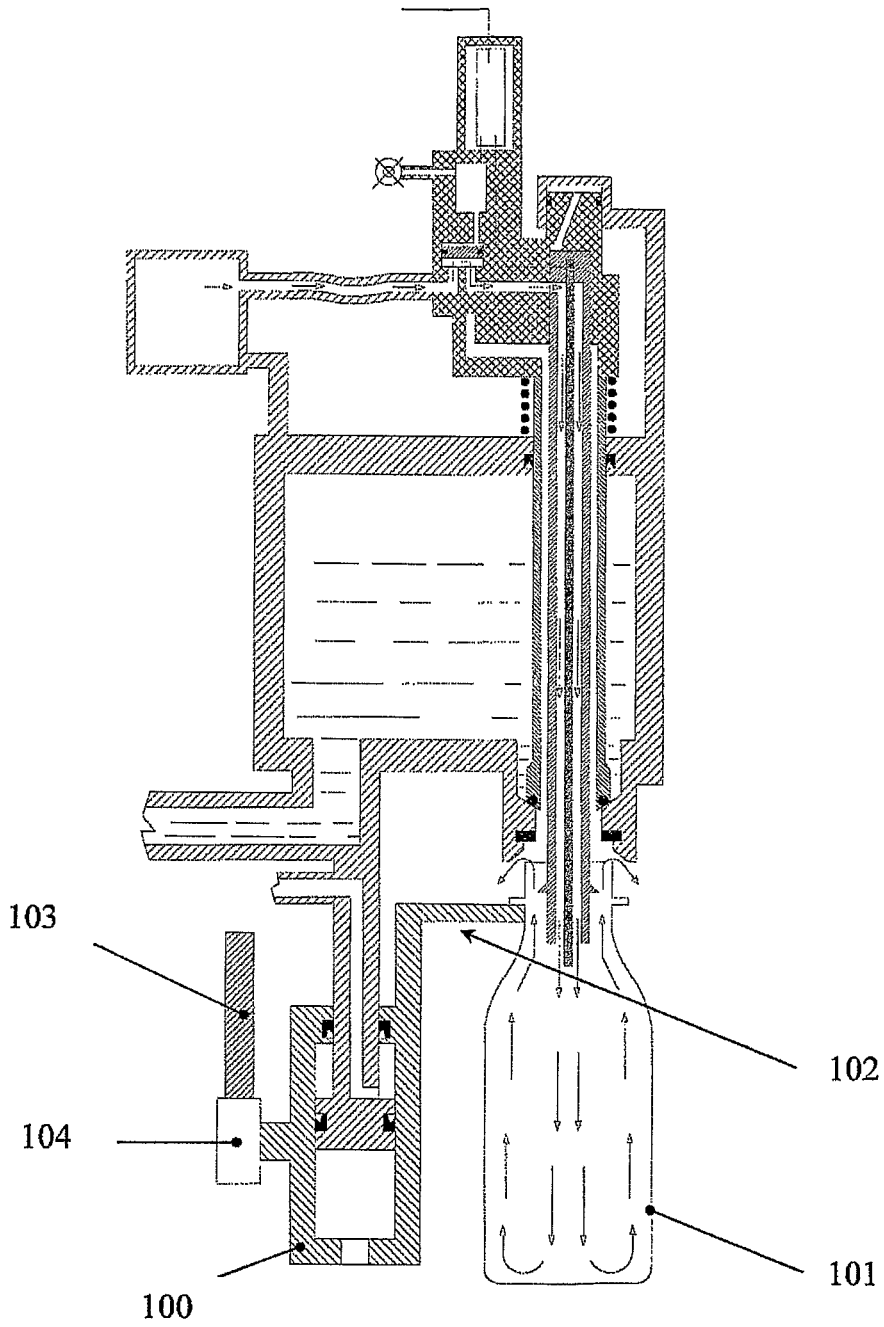
FIG. 1 shows a side cross-section view of a filler valve made according to the known technology.
Figure 2:
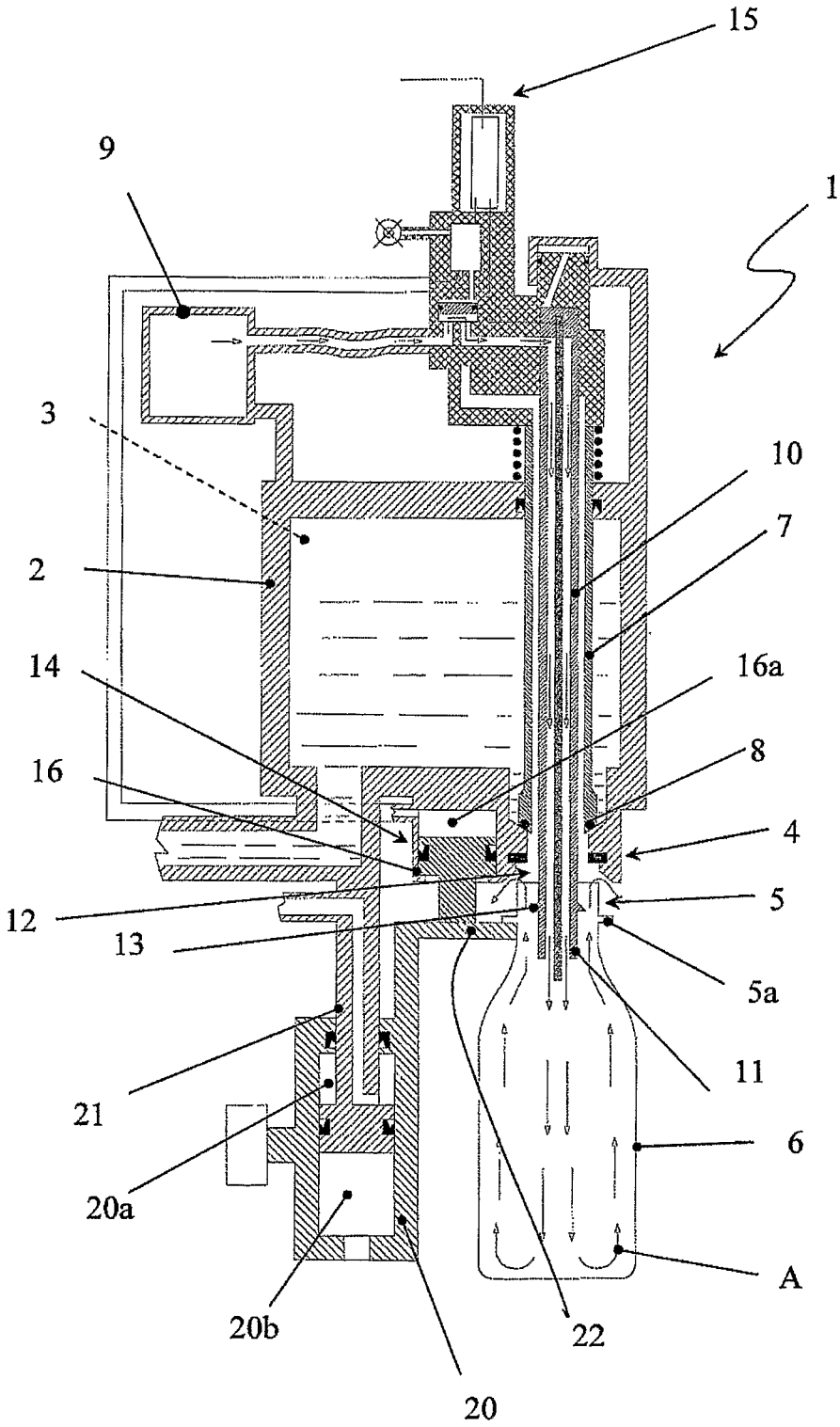
FIG. 2 shows a side cross-section view of a filler valve unit during the flushing stage and made according to the present invention.
Figure 3:
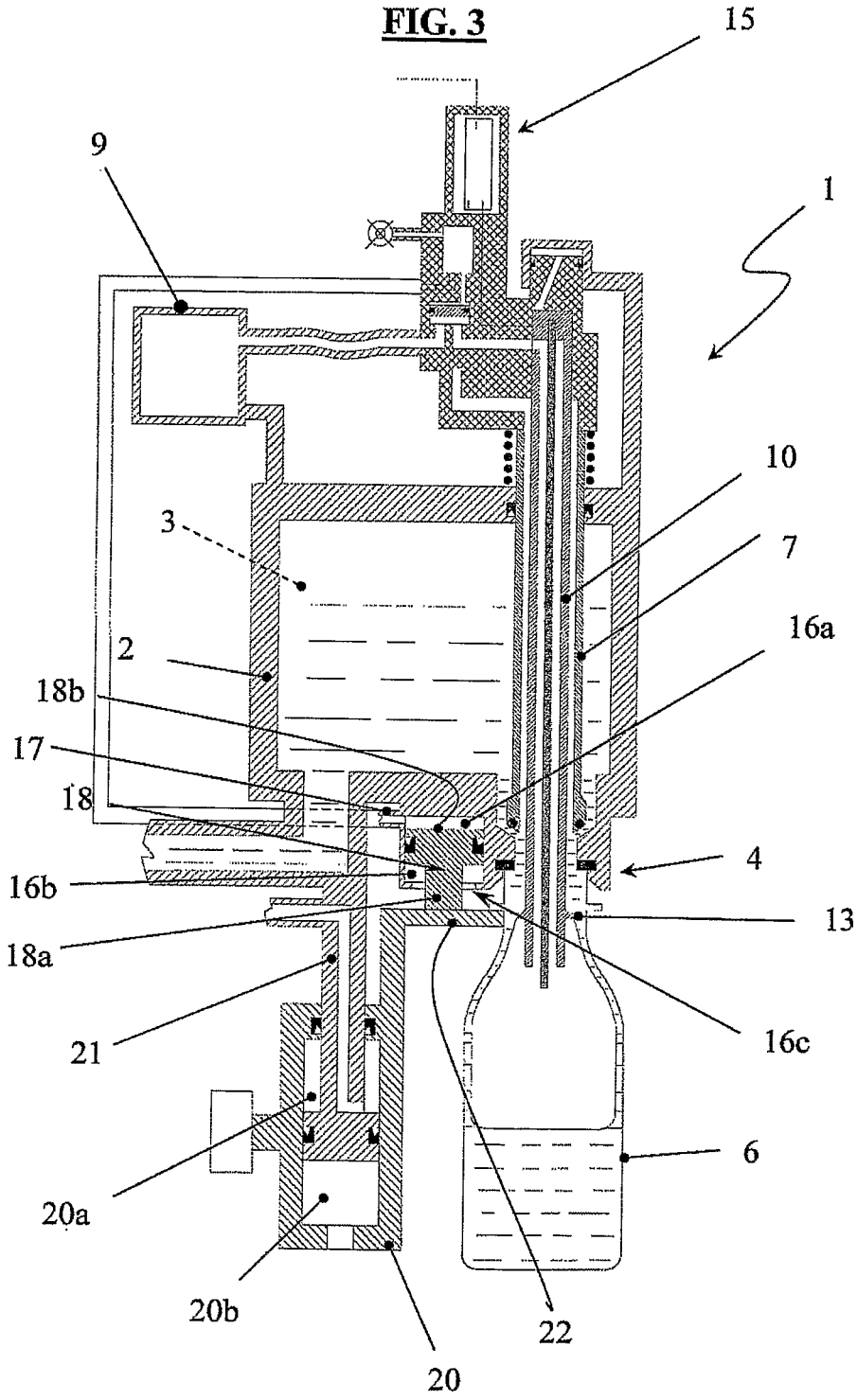
FIG. 3 shows a side cross-section view of the filler valve unit shown in FIG. 2 during the filling stage.

The FIGS. 2 and 3 show a filler valve unit according to the present invention and referred to as a whole with the number 1. In a preferred embodiment the valve unit is used to fill containers made from a plastic material. The containers could for example be PET bottles.

The valve unit 1 comprises feeding means for feeding a preset quantity of liquid into a container and means for injecting a gaseous fluid, preferably carbon to dioxide or an inert gas, into the container before filling the container with liquid and where the injection means are connected to the feeding means.

The gaseous fluid injection stage, commonly known as the flushing stage, is necessary in order to expel the oxygen present inside the container and thus enable filling of the container with liquids such as beer which are sensitive to oxygen.

In the preferred embodiment shown in FIGS. 2 and 3, the feeding means comprise a tank 2 containing a filling liquid 3 with an outlet 4, preferably a nozzle, for feeding out the filling liquid. In that case, the nozzle 4 is shaped to accept the mouth 5 of a container 6, usually a bottle.

FIGS. 2 and 3 show feeding means comprising a stop valve 7 acting together with the nozzle 4 and moving between a closed position where the stop valve 7 is inserted in the nozzle 4, thus preventing the passage of the filling liquid 3 through said nozzle 4 from the tank 2, and an open position where the stop valve 7 permits the passage of the filling liquid 3 through said nozzle 4.

In the preferred embodiment the stop valve 7 has on its outside surface a seal 8, usually a lip-type seal, designed to hermetically seal the outlet of the tank 2 during the non-filling stages of the cycle.

FIGS. 2 and 3 show injection means comprising a reservoir 9 containing a gaseous fluid, preferably carbon dioxide or inert gas, and an injection pipe 10 connected to the reservoir 9 and having an outlet 11 shaped so that it can enter the mouth 5 of the container 6.

In the preferred embodiment shown in FIGS. 2 and 3, the stop valve 7 is tubular and inside contains, in a coaxial position, the injection pipe 10 in such a way that during the filling stage the end part 12 of the injection pipe 10 is hit by to the flow of filling liquid.

The injection pipe 10 has a flow deflector 13 fitted to its end part 12 whose purpose is to direct the flow of filling liquid against the sides of the container 6 so as to prevent the formation of foam inside the container.

The filler valve unit comprises at least one stop element 14 forming a stroke limiter acting on a container and functionally connected to the feeding and injection means.

The stop element 14 is mobile and moves between at least two operating positions consisting of a first operating position where the stop element holds the mouth 5 of the container 6 at a preset distance from the outlet of the feeding means and a second operating position where the stop element 14 holds the mouth of the container 6 at a distance from the outlet of the feeding means which is less than the preset distance.

In the embodiment shown in FIGS. 2 and 3, the preset distance, henceforth referred to as the flushing distance, is the distance during the flushing stage between the mouth 5 of the container 6 and the nozzle 4 of the feeding means. In order to permit the gaseous fluid to fill the container and at the same time expel the oxygen inside the container, it is necessary to hold the container at a preset distance from the nozzle 4.

The arrows marked with the letter A in FIG. 2 indicate the direction of flow of the gaseous fluid during the flushing stage.

The filling distance, which is the distance between the mouth 5 of the container 6 and the nozzle 4 during the filling stage, is less than the preset distance. In the preferred embodiment, the filling distance is substantially zero in order to prevent oxygen from entering the container during the filling stage.

In the preferred embodiment shown in FIGS. 2 and 3, the injection pipe 10 acts, during the filling stage, as a pipe for expelling the gaseous fluid previously fed into the container during the flushing stage.

In the embodiment described here the feeding means, preferably the stop valve 7, the injection means and the stop element 14 are functionally connected to a control unit designed to control the movement of the stop element and the operation of the feeding means and the injection means.

Preferably this control unit consists of at least one solenoid valve 15.

In the preferred embodiment, the stop element 14 is connected to a circuit containing actuating fluid at a preset pressure acting on the stop element in order to move it between the first and second operating positions corresponding to the flushing stage and the filling stage respectively.

Preferably, the stop element 14 comprises a slider 18 housed in a seat 16 moving between a first active position where the actuating section 18*a* of the slider 18 projects from the seat 16 and a second active position where the actuating section 18*a* of the slider 18 is at least partially contained in the seat 16.

Preferably the slider consists of a piston with a head 18*b* and a rod 18*a*, which defines the actuating section.

The seat 16 has an opening 16*c*, preferably a through hole, to allow the rod 18*a* of the piston 18 to project from the seat.

In FIG. 2, the slider 18 divides the seat 16 into two chambers 16*a*, 16*b* each having a volume which varies according to the position of the head 18*b* inside the seat 16.

In a preferred embodiment, the chamber 16*b* communicates with the outside environment by means of the opening 16*c* which allows the rod 18*a* of the piston 18 to project from the seat 16. In effect the piston 18 is of the single-acting type.

When the slider 18 moves, the air in the external environment feeds into the chamber 16*b* changing the pressure inside the chamber to atmospheric pressure, that is, to approximately 1 bar.

The filler valve unit 1 comprises means for applying a preset pressure to an actuating fluid present in at least one of the chambers 16*a*, 16*b* so as to move the piston 18 inside the seat and so that the actuating section of the piston defined by the rod 18*a* moves between the first and second active positions.

Preferably, the means for applying pressure are connected to the chamber 16*a* by a pipe 17 and apply a preset pressure to the actuating fluid present in the chamber 16*a* and the pipe 17; the actuating fluid in the chamber 16*a* and the pipe 17 is preferably air, inert gas or oil.

Preferably, the means for setting the pressure inside the chamber 16*a* comprises a pump.

The feeding of fluid under pressure into the chamber 16*a* through the pipe 17 is controlled preferably by the above mentioned solenoid valve 15 present in the control unit.

The solenoid valve 15 controls the feeding of fluid under pressure into the chamber 16*a* and, preferably, also controls the supply of filling liquid and the injection of the gaseous flushing fluid. In practice, as illustrated on FIGS. 2 and 3, the solenoid valve 15 is functionally connected to the feeding means, to the injection means and to the means for applying a preset pressure inside the chamber 16*a*. The solenoid valve 15 also controls the piston 18 and the actuators of the feeding and injection means and thereby also controls the flushing and filling stages.

In an alternative embodiment consisting of a variant not illustrated here, a plurality of solenoid valves can be used where each solenoid valve controls one or more of the following stages: filling, flushing and feeding fluid under pressure into the chamber 16*a*.

In FIGS. 2 and 3, the stop element 14 acts on lifting means designed to move the mouth 5 of the container 6 towards the valve unit 1.

In the example illustrated, the lifting means comprise a pneumatic cylinder 20 sliding vertically on a fixed guide 21 defined by a piston.

The cylinder 20 has a pick-up 22 shaped to engage with the container 6 and grip it by its neck 5*a*.

The filler valve unit according to the invention operates as follows.

The containers 6 are raised towards the valve unit 1 following a vertical movement of the cylinder 20 along the fixed guide 21.

The upward and downward movement of the cylinder 20 is controlled by the pressure difference of the fluid inside the upper and lower chambers, 20*a* and 20*b* respectively, defined inside the cylinder. The chambers 20*a*, 20*b* have a volume which varies according to the related movement of the cylinder 20 and the guide 21.

The difference in pressure between the upper chamber 20*a* and the lower chamber 20*b* is created by feeding fluid under pressure in or out of the upper chamber 20*a* only.

The pick-up 22 being fixed to the cylinder 20 is also raised towards the valve unit 1 and thus moves the mouth 5 of the container 6 towards the nozzle 4. During the stage when the container 6 is being raised, the solenoid valve 15 actuates the flow of fluid under pressure into the chamber 16*a* of the seat 16, through the pipe 17 thus causing the piston 18 to move downwards and the rod 18*a* to project from the seat 16 through the opening 16*c*.

The cylinder 20 continues its stroke along the guide 21 causing the pick-up 22 to impact against the rod 18*a* of the piston 18. This movement positions the mouth 5 of the container 6 at the preset flushing distance from the nozzle 4.

The forward stroke of the cylinder 20 along the guide 21 is made possible by the presence of fluid at a higher pressure inside the upper chamber 20*a*; that is, the pressure of the fluid inside the upper chamber 20*a* is greater than the pressure of the fluid inside the lower chamber 20*b* and thus drives the raising movement of the cylinder 20. Preferably, the lower chamber 20*b* communicates with the outside environment and the cylinder 20 is therefore of the single-acting type. The pressure inside the lower chamber 20*b* is atmospheric pressure.

This is followed by the flushing stage where a gaseous fluid is injected into the container.

At the end of the flushing stage, the solenoid valve 15 actuates an exhaust of the fluid from the chamber 16*a* of the seat 16, thus causing a decreasing of pressure in said chamber 16*a* and an upward movement of the piston 18 and the retraction, at least partial, of the rod 18*a* inside the seat 16.

When the rod 18*a* retracts, the cylinder 20, whose pick-up 22 was resting against the rod, continues its stroke along the guide 21 thus raising the mouth 5 of the container 6 so that it makes contact with the nozzle 4.

Next, the valve 7 opens the outlet of the tank 2 to start the filling stage.

The invention has considerable advantages.

First and foremost, a filler valve unit constructed according to the present invention enables a rapid size changeover of the containers to be filled without the need for long machine downtimes.

A further advantage of a filler valve unit constructed according to the present invention is the optimisation of filling equipment productivity through the prevention of wastage in gas and containers. In the event of an unexpected machine stoppage, for example, the solenoid valve 15 will actuate retraction of the rod 18*a* so as to move the container towards the nozzle 4 ready for filling and thus preventing the expulsion of the flushing fluid just injected into the container. Filler valve units constructed in accordance with the known technology, on the other hand, in the event of an unexpected machine stoppage do not allow the filling of those containers which have completed the flushing stage but which have not yet reached the feed section of the valve. With the known technology the presence of a cam with a preset, fixed profile will not allow the container to approach the filling section of the valve to start filling. This allows the flushing fluid to escape and oxygen to enter the container again. This causes an unnecessary waste of carbon dioxide or inert gas and a loss of productivity due to the rejection of the containers which have already been treated with gas but have not been tilled. These disadvantages are entirely solved by a filler valve unit constructed according to the present invention.

The invention claimed is:

1. A filler valve unit (1) comprising:

feeding means (2, 7) for feeding a preset amount of filling liquid (3) into a container (6) wherein the feeding means (2, 7) have an outlet (4) for feeding out filling liquid, the outlet (4) being a nozzle;

injection means (9, 10) for injecting a gaseous fluid into a container (6) wherein the injection means (9, 10) have an outlet (11) for injecting gaseous fluid and are connected to the feeding means (2, 7), at least one stop element (14) forming a stroke limiter acting on the container (6) and functionally connected to the feeding means (2, 7) and to the injection means (9, 10), the stop element (14) being mobile and moving between at least two operating positions consisting of:

a first operating position wherein the stop element holds a mouth (5) of the container (6) at a preset flushing distance from the nozzle (4) of the feeding means (2, 7); in the first operating position the mouth (5) not being in contact with the nozzle (4);

a second operating position wherein the stop element (14) holds the mouth (5) of the container (6) at a filling distance from the nozzle (4) of the feeding means (2, 7) which is less than the preset flushing distance, the filling distance being zero in order to prevent oxygen from entering the container during the filling stage; in the second operating position the mouth (5) being in contact with the nozzle (4);

the preset flushing distance being the distance during a flushing stage between the mouth (5) of the container (6) and the nozzle (4) of the feeding means, the preset flushing distance permitting the gaseous fluid to fill the container (6) and at the same time expelling the oxygen inside the container (6); the filling distance being the distance between the mouth (5) of the container (6) and the nozzle (4) during the filling stage of the container with the filling liquid, the filling distance being less than the preset flushing distance; the feeding means (2, 7), the injection means (9, 10) and the stop element (14) being functionally connected to a control unit designed to control the movement of the stop element (14) and the operation of the feeding means (2, 7) and the injection means (9, 10).

2. A filler valve unit according to claim 1 wherein the control unit comprises at least one solenoid valve (15).

3. A filler valve unit according to claim 1 wherein the stop element (14) is functionally connected to a circuit containing actuating fluid at a preset pressure acting on the stop element (14) in order to move it between the first and second operating positions.

4. A filler valve unit according to claim 1 wherein the stop element (14) comprises a slider (18) housed in a seat (16) moving between a first active position wherein the actuating section (18*a*) of the slider (18) projects from the seat (16) and a second active position wherein the actuating section (18*a*) of the slider (18) is at least partially contained in the seat (16).

5. A filler valve unit according to claim 4 wherein the slider (18) divides the seat (16) into two chambers (16*a*, 16*b*) each of which has a variable volume which is a function of the position of the slider (18) inside the seat (16).

6. A filler valve unit according to claim 5 comprising means for applying a preset pressure to the actuating fluid present in at least one of the chambers (16*a*, 16*b*) so that the actuating section (18*a*) of the slider (18) moves between a first active position and a second active position.

7. A filler valve unit according to claim 6 comprising control means connected to the feeding means (2, 7), the injection means (9, 10) and the means for applying a preset pressure to at least one of the chambers (16*a*, 16*b*) so as to actuate the movement of the slider (18) and control the feeding means (2, 7) and the injection means (9, 10) so as to operate the flushing and filling stages.

8. A filler valve unit according to claim 7 wherein the control means comprise at least one solenoid valve (15).

9. A filler valve unit according to claim 1 wherein the stop element (14) acts on lifting means (20, 21) designed to move the mouth (5) of a container (6) towards the valve unit (1).

10. A filler valve unit according to claim 1 wherein the feeding means comprise:

a tank (2) containing a filling liquid (3) with at least one outlet (4) for feeding out the filling liquid wherein the outlet (4) is shaped to accept the mouth (5) of the container (6);

a valve (7) connected to the outlet (4) and moving between a closed position and an open position of the outlet (4).

11. A filler valve unit according to claim 1 wherein the injection means comprise:

a reservoir (9) containing a gaseous fluid;

an injection pipe (10) connected to the reservoir (9) and having an outlet (11) shaped so that it can enter the mouth (5) of the container (6).

12. A filler valve unit according to claim 1 wherein the feeding means and the injection means comprise together:

a tank (2) containing a filling liquid (3) having an outlet (4) for feeding out liquid and wherein the outlet (4) is shaped so that it can enter the mouth (5) of the container (6);

a reservoir (9) containing a gaseous fluid;

a tubular valve (7) connected to the outlet (4) and moving between an open position and a closed position so that a section of the side surface of the valve (7) acts on the outlet (4) so as to obstruct it;

an injection pipe (10) connected to the reservoir (9) containing the gaseous fluid and having an outlet (11) shaped so that it can enter the mouth (5) of the container (6) and wherein the injection pipe (10) is positioned coaxially to the valve (7).

13. A filler valve unit according to claim 12 wherein the injection pipe (10) has a flow deflector (13) positioned on an end part (12) of the injection pipe (10) designed to be hit by the filling liquid and whose purpose is to prevent the formation of foam inside the container.

14. A filler valve unit according to claim 11 wherein the injection pipe (10) acts, during the filling stage, as a pipe for expelling the gaseous fluid previously fed into the container during the flushing stage.

15. A filling machine characterised by the fact that it has a filler valve unit (1) according to claim 1.

* * * * *